United States Patent [19]

Dimitroff, Jr. et al.

[11] Patent Number: 4,598,551

[45] Date of Patent: Jul. 8, 1986

[54] APPARATUS AND METHOD FOR CONTROLLING STEAM TURBINE OPERATING CONDITIONS DURING STARTING AND LOADING

[75] Inventors: Vladimir T. Dimitroff, Jr., Sanbornville, N.H.; James B. Wagner, Peabody, Mass.

[73] Assignee: General Electric Company, Lynn, Mass.

[21] Appl. No.: 791,490

[22] Filed: Oct. 25, 1985

[51] Int. Cl.[4] ..... F01K 13/02

[52] U.S. Cl. ..... 60/646; 60/663; 60/679

[58] Field of Search ..... 60/646, 679, 663

[56] References Cited

U.S. PATENT DOCUMENTS

| | | | |
|---|---|---|---|
| 2,586,510 | 2/1952 | Bryant | 60/663 X |
| 2,586,511 | 2/1952 | Bryant | 60/663 X |
| 3,069,859 | 12/1962 | Weehuizen | 60/663 |
| 3,264,826 | 8/1966 | Kane et al. | 60/679 X |

*Primary Examiner*—Allen M. Ostrager

*Attorney, Agent, or Firm*—James W. Mitchell

[57] ABSTRACT

A steam turbine-generator system includes a reheater bypass valve which cooperates with both a high- and low-pressure bypass valve in the early stages of turbine loading to divert steam in a bypass flow from a high-pressure turbine to the input of a reheat turbine without passing the steam through a reheat portion of the boiler. The pressure and temperature drops in the high-pressure turbine are controlled by the setting of the pressure threshold of the low-pressure bypass valve. A check valve prevents steam flow into the reheat portion of the boiler until a desired operating condition is attained. The steam flowing to the reheat turbine directly from the high-pressure turbine is at a sufficiently low temperature to avoid temperature insult to the rotor of the reheat turbine. Once the turbine is partially loaded, the reheater bypass, high-pressure bypass and low-pressure bypass valves are closed to establish a conventional reheat turbine configuration. During a cold start, the main stop valve is employed to throttle steam to the high-pressure turbine to additionally decrease the temperature of the steam exiting the high-pressure turbine.

13 Claims, 3 Drawing Figures

APPARATUS AND METHOD FOR CONTROLLING STEAM TURBINE OPERATING CONDITIONS DURING STARTING AND LOADING

BACKGROUND OF THE INVENTION

The present invention relates to steam turbines and, more particularly, to steam turbines of the type having at least a high-pressure turbine and a reheat turbine wherein a reheat portion of an associated boiler adds heat to exhaust steam from the high-pressure turbine before the reheated steam is applied to the reheat turbine.

A medium or large steam turbine represents such a major investment to its owners that great care in its operation is essential to ensure completion of its operational lifetime. Major causes for concern exist during startup and loading of a steam turbine either from a cold or a hot condition. Specifically, the life of a steam turbine is critically affected by the thermal and mechanical stresses to which it is exposed during startup and loading.

As hot steam is admitted to a cold steam turbine, thermal gradients are produced between the outer and inner portions of the turbine rotor. A correlation can be made between the magnitude of the thermal gradients and a reduction in the number of times the steam turbine may be started from a cold or hot condition without overstressing the rotor and casing materials. For example, if the temperature of the incoming steam exceeds the external surface temperature of the turbine wheels by 400 degrees F. during each startup cycle, a typical steam turbine is capable of withstanding only one-fifth as many startup cycles compared to a steam turbine in which the steam-to-metal temperature difference is limited to about 300 degrees F. It can thus be seen that a difference of only 100 degrees F. in steam-to-metal temperature has a major effect on the lifetime of a steam turbine subjected to repeated starting and stopping.

In a steam turbine containing both a high-pressure turbine and a reheat turbine, coordinated control of thermal gradients is required in both turbines. Such coordinated control is complicated by the differences between the two turbines and the manner in which steam flows thereto.

In addition to the control of the thermal gradients, close control of turbine acceleration is also required during startup to ensure that inertially derived radial wheel stresses, added to thermally derived stresses, remain within tolerable limits until the rotors in each turbine stage become heat soaked.

The acceleration limits are especially severe in a steam turbine driving an electric generator prior to synchronization of the electric generator with the network line frequency because the speed of the steam turbine is acutely responsive to small variations in steam flow in this condition. After the generator is synchronized to the line frequency, the turbine speed remains essentially constant under control of the line frequency. Large capacity steam control valves normally employed during a turbine loaded condition may be somewhat imprecise to control steam turbine speed under low flow conditions usually encountered prior to synchronization.

The prior art employs a cold starting technique wherein the high-pressure and reheat steam turbines are warmed by injecting steam into the exhaust of a high-pressure turbine stages while the boiler temperature and pressure are brought up to operating conditions. A ventilator valve in the inlet piping of the high-pressure steam turbine is opened to exhaust part of the steam which has flowed in the reverse direction from exhaust to inlet.

The reheat steam turbine is mechanically and physically integrated with the high-pressure steam turbine on a common shaft within a common housing. Steam in the high-pressure steam turbine is normally sealed from flowing along the common shaft to the reheat steam turbine by an inter-turbine seal. While the steam is fed in reverse flow for warming the high-pressure steam turbine, the inter-turbine shaft seal is opened to permit a part of the warming steam to flow past the shaft seal into the reheat steam turbine for warming thereof.

The above warming technique using reverse steam flow through the high-pressure steam turbine depends on the accessibility of steam piping at the inlet end of the high-pressure steam turbine in which the ventilator valve may be installed. Certain types of steam turbines integrate the turbine inlet connections from the step valve piping the steam chests with multiple control valves and individual valve ports to the turbine inlet nozzle sections within a unitary casing. Such integration denies access to the inlet steam nozzle port passages for installation of a ventilator valve and makes warming by reverse steam flow less desirable.

Starting a hot steam turbine after a load rejection or a system trip, while boiler temperature and pressure are at, or near, full operating levels, also presents a problem of thermal gradients, particularly in the reheat turbine. Although the reheat turbine rotor is hot, its temperature is considerably below that of the steam available from the reheat portion of the boiler during the early stages of turbine loading. Thus, reduced turbine lifetimes, measured in the number of loading cycles which may be withstood, is possible.

The prior art also employs high-pressure and low-pressure bypass valves in an attempt to control the warming rate, turbine acceleration and speed while permitting sufficient steam to pass through the reheat portion of the boiler to prevent damage to the reheat portion boiler tubes.

The high-pressure bypass valve conventionally diverts superheated steam from the upstream side of the main bypass control valve to the cold side of the reheat portion of the boiler during the startup sequence. This bypass steam flow reduces the amount of steam which must flow through the high-pressure steam turbine and thus provides an additional control on the turbine speed.

The low-pressure bypass valve diverts steam from the hot side of the reheat portion of the boiler to the condenser instead of requiring it to flow through the reheat turbine. During the early stage of bringing the boiler up to operating conditions, the steam flow through the low-pressure bypass valve maintains a cooling flow of steam through the boiler tubes in the reheat portion of the boiler. During the early stages of turbine acceleration and loading, the low-pressure bypass valve aids in the control of the amount of steam fed to the reheat turbine and thereby aids in the control of turbine acceleration.

The above techniques using bypass valves are unable to provide satisfactory positive limits on coordinated heating of the two steam turbines, and of turbine speed during acceleration and the early stages of turbine loading during either a cold or hot start.

OBJECTS AND SUMMARY OF THE INVENTION

Accordingly, it is an object of the invention to provide a control system for a steam turbine which overcomes the drawbacks of the prior art.

It is a further object of the invention to provide apparatus and method for controlled bypass of the reheat section of a boiler whereby a high-pressure turbine and a reheat turbine may be operated as a straight, condensing, non-reheat turbine during selected portions of a startup cycle.

It is a still further object of the invention to provide apparatus and method for controlling a steam turbine wherein a sufficient amount of energy is extracted from steam passing through a lightly loaded high-pressure steam turbine to temper the temperature of the steam fed directly to a reheat steam turbine during at least a portion of startup and loading of the steam turbine.

Briefly stated, the present invention provides a steam turbine-generator system in which a reheater bypass valve cooperates with both a high- and a low-pressure bypass valve in the early stages of turbine loading to divert steam in a bypass flow from a high-pressure turbine to the input of a reheat turbine without passing the steam through a reheat portion of the boiler. The pressure and temperature drops in the high-pressure turbine are controlled by the setting of the pressure threshold of the low-pressure bypass valve. A check valve prevents steam flow into the reheat portion of the boiler until a desired operating condition is attained. The steam flowing to the reheat turbine directly from the high-pressure turbine is at a sufficiently low temperature to avoid temperature insult to the rotor of the reheat turbine. Once the turbine is partially loaded, the reheater bypass, high-pressure bypass and low-pressure bypass valves are closed to establish a conventional reheat turbine configuration. During a cold start, the main stop valve is employed to throttle steam to the high-pressure turbine to additionally decrease the temperature of the steam exiting the high-pressure turbine.

According to an emboodiment of the invention, there is provided a steam turbine-generator system comprising a high-pressure steam turbine, a reheat turbine, a boiler including means for heating steam for delivery to the high-pressure steam turbine and a boiler reheat portion for reheating an exhaust steam from the high-pressure steam turbine for delivery to the reheat turbine, main valve means for admitting steam from the boiler to the high-pressure steam turbine, an intercept control valve for admitting steam from the boiler reheat portion to the reheat turbine, means for maintaining at least a selectable predetermined pressure in the boiler reheat portion, a reheater bypass assembly connected between a high-pressure turbine exhaust line of the high-pressure steam turbine and a reheat turbine inlet line of the reheat turbine, the reheater bypass assembly bypassing the boiler reheat portion and the intercept control valve, a check valve in the high-pressure turbine exhaust line downstream of the reheater bypass assembly, and the check valve including means for preventing flow of steam from the high-pressure turbine exhaust line to the boiler reheat portion while an exhaust pressure of steam from the high-pressure steam turbine is lower than the selectable predetermined pressure, whereby exhaust steam from the high-pressure steam turbine passes through the reheater bypass assembly directly to the reheat turbine without passing through the boiler reheat portion during at least a portion of a startup cycle.

According to a feature of the invention, there is provided a method for startup of a steam turbine-generator system of a type including a high-pressure steam turbine, a reheat turbine, a boiler including means for heating steam for delivery to the high-pressure steam turbine and a boiler reheat portion for reheating an exhaust steam from the high-pressure steam turbine for delivery to the reheat turbine, main valve means for admitting steam from the boiler to the high-pressure steam turbine, an intercept control valve for admitting steam from the boiler reheat portion to the reheat turbine, comprising maintaining at least a selectable predetermined pressure in the boiler reheat portion, bypassing an exhaust from the high-pressure steam turbine to an inlet of the reheat turbine without passing the exhaust through the boiler reheat portion and the intercept control valve, and preventing flow of steam from the high-pressure turbine exhaust line to the boiler reheat portion while an exhaust pressure of steam from the high-pressure steam turbine is lower than the selectable predetermined pressure, whereby exhaust steam from the high-pressure steam turbine passes directly to the reheat turbine without passing through the boiler reheat portion during at least a portion of a startup cycle.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
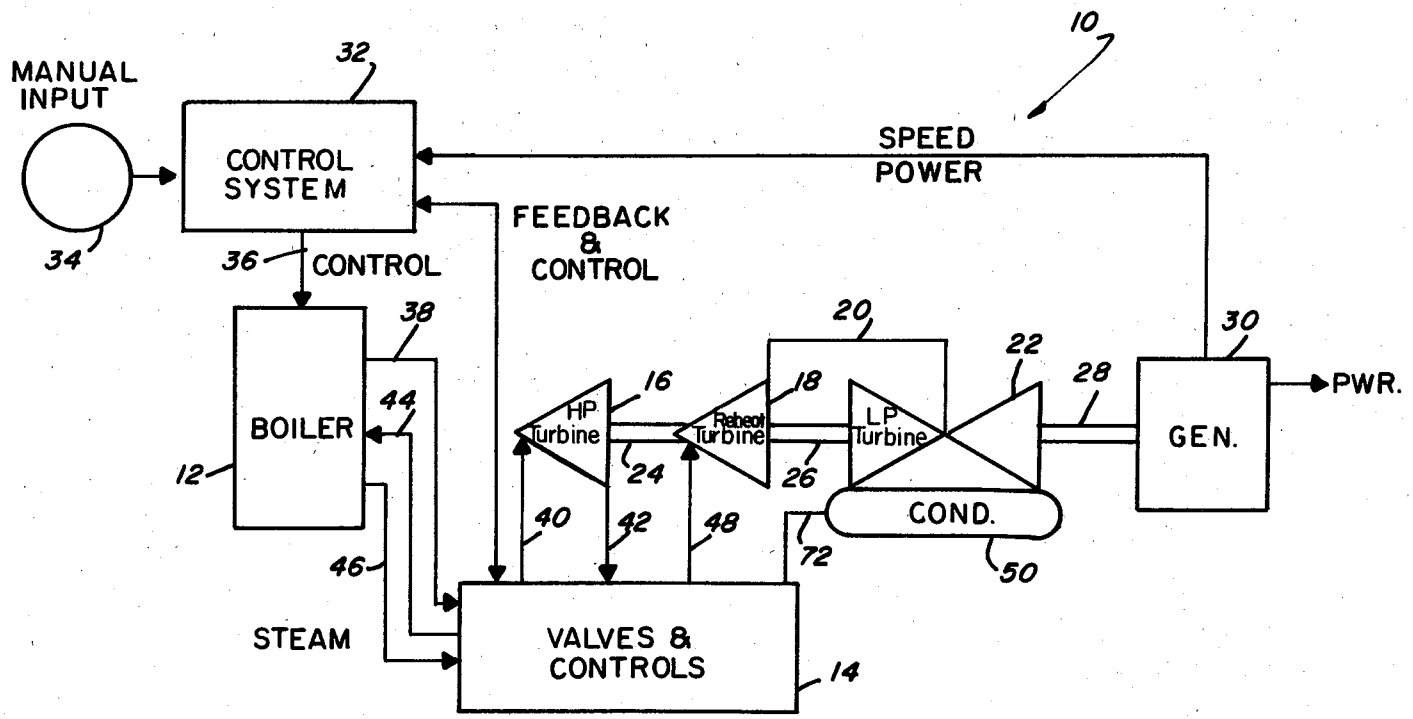
FIG. 1 is a simplified schematic diagram of a steam turbine-generator system according to an embodiment of the invention.

Referring to FIG. 1, there is shown, generally at 10, a steam turbine-generator system according to an embodiment of the invention. A boiler 12 produces steam which is fed through a valves and controls assembly 14 to a high-pressure steam turbine 16, a reheat turbine 18 and a low-pressure turbine 22. A shaft 24 of high-pressure steam turbine 16, an output shaft 26 of reheat turbine 18 and a shaft 28 of low-pressure turbine 22 are concentrically aligned, and mechanically connected to apply the combined torques of high-pressure steam turbine 16, reheat turbine 18 and low-pressure turbine 22 to an electric generator 30. Electric generator 30 may be connected to an electric grid thereby to produce electric power in response to the sum of the applied torques.

Steam turbine-generator system 10 is controlled by a control system 32 which may be fully automatic or, preferably, responsive to at least some control inputs from a manual input 34. A control line 36 from control system 32 applies boiler control signals to boiler 12 which are effective to control the firing rate of boiler 12. As is conventional, the control of the firing rate may include control of the number of burners (not shown) of a liquid, gaseous or solid fuel, or a combination thereof, and the rate at which the fuel is delivered to the burners.

Superheated steam generated in boiler 12 is applied on a main steam line 38 to valves and controls assembly 14 for application to high-pressure steam turbine 16 on a line 40. Exhaust steam from high-pressure steam turbine 16 flows on a high-pressure turbine exhaust line 42 to valves and controls assembly 14 from whence it returns on a cold reheat line 44 to a reheat portion (not shown) of boiler 12. After receiving additional heat, the steam is applied on a hot reheat line 46 to valves and controls assembly 14 for application on a reheat turbine inlet line 48 to reheat turbine 18.

In normal operation, steam from boiler 12 is expanded in high-pressure steam turbine 16 to produce torque, returned through boiler 12 for reheating, further expanded in reheat turbine 18 and fed on a reheat turbine exhaust line 20 to low-pressure turbine 22 where it is finally expanded before being condensed in a condenser 50. During startup, however, coordinating the heating of high-pressure steam turbine 16 and reheat turbine 18 with the operation of boiler 12 requires a control precision which is not achievable using such conventional steam flow.

Figure 2:
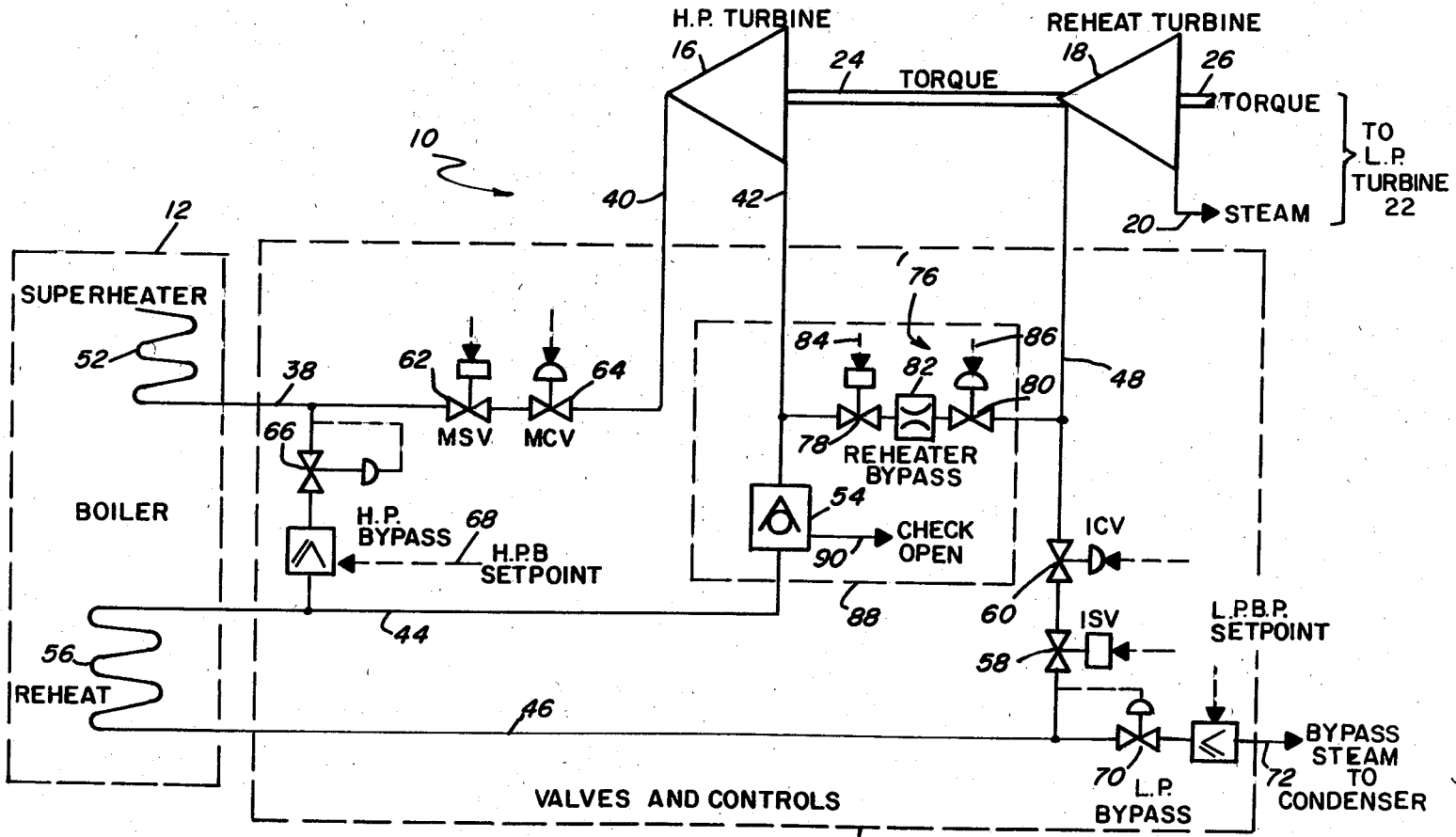
FIG. 2 is a more detailed schematic diagram of a portion of the steam turbine-generator system of FIG. 1.

Referring now to FIG. 2, the steam, superheated to a temperature of about 1000 degrees F. and a pressure of 2000 PSIG in a superheater portion 52 during fully loaded operation, expands in high-pressure steam turbine 16 to produce a torque on shaft 24. The expanded steam exits high-pressure steam turbine 16 at a temperature of about 450 degrees F. and a pressure of about 400 PSIG on high-pressure turbine exhaust line 42. The exhaust steam passes through a non-return or check valve 54 and cold reheat line 44 to a reheat portion 56 in boiler 12. The steam is reheated to about 1000 degrees F. in reheat portion 56 before being delivered through hot reheat line 46, an intercept stop valve 58, an intercept control valve 60 and reheat turbine inlet line 48 to the inlet of reheat turbine 18.

During normal loaded operation, main stop valve 62, intercept stop valve 58 and intercept control valve 60 are fully open, and a main control valve 64 is in throttling condition to maintain a desired amount of torque on output shaft 26. The speed of steam turbine-generator system 10 is normally controlled by the frequency of the power grid to which electric generator 30 (FIG. 1) is connected. Control inputs from control system 32 (FIG. 1) to all valves are indicated by dashed arrows in FIG. 2.

In addition to the above elements used during normal operation, additional elements are provided to control thermal and mechanical stresses during cold and hot starting and loading.

A high-pressure bypass valve 66 is connected between main steam line 38 and cold reheat line 44 to bypass a predetermined portion of the steam directly to reheat portion 56 without passing through high-pressure steam turbine 16. High-pressure bypass valve 66 is capable of automatically opening and closing to maintain, or attempt to maintain, a predetermined pressure in main steam line 38 in response to a high-pressure bypass setpoint signal applied to it on a high-pressure bypass control line 68. During normal operation, the signal on high-pressure bypass control line 68 selects a pressure setpoint exceeding the operational pressure and thus, in its attempt to maintain the pressure in main steam line 38 at the setpoint pressure, high-pressure bypass valve 66 remains closed.

A low-pressure bypass valve 70 is connected between hot reheat line 46 and a condenser inlet line 72. Low-pressure bypass valve 70 is also capable of automatically opening and closing in response to a low-pressure bypass control signal on a low-pressure bypass control line 74 to maintain, or attempt to maintain, a predetermined pressure in hot reheat line 46. During normal operation, the signal on low-pressure bypass control line 74 selects a pressure setpoint exceeding the operational pressure on hot reheat line 46 and thus, in its attempt to maintain the pressure in hot reheat line 46 at the setpoint pressure, low-pressure bypass valve 70 remains closed.

A reheater bypass assembly 76 is connected to conduct steam directly from high-pressure turbine exhaust line 42 to reheat turbine inlet line 48 without passing through reheat portion 56. Reheater bypass assembly 76 includes a reheater bypass stop valve 78 and a reheater bypass control valve 80. Reheater bypass control valve 80 is intentionally designed with a constriction to produce a pressure differential across it of about 3:1. Although this constriction is, in fact, an integral part of reheater bypass control valve 80, because of its importance to an understanding of the invention, it is represented separately as constriction 82. Reheater bypass stop valve 78 and reheater bypass control valve 80 are controlled by control signals on control lines 84 and 86, respectively.

The elements added to the conventional hardware of steam turbine-generator system 10 are outlined in a dashed box 88. Due to the presence of the elements in dashed box 88, the remaining conventional hardware elements are controlled during portions of an operational cycle in an unconventional manner to produce a vastly different and improved result. The operational cycles are described in the following.

Operation During Cold Start

Figure 3:
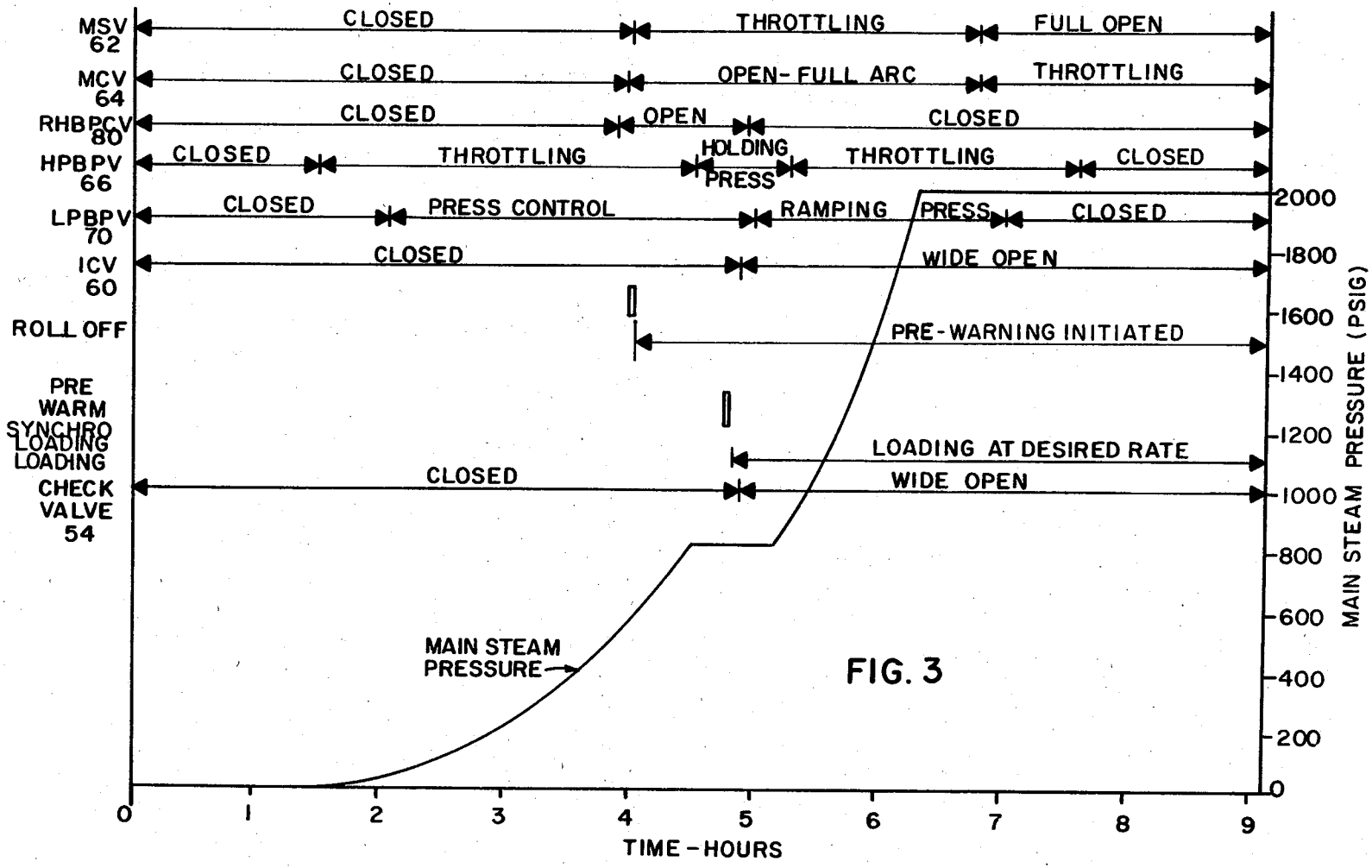
FIG. 3 is a combination drawing showing the timing of events during a cold startup plotted on the same time scale with a curve showing the boiler pressure.

Reference may now also be made to FIG. 3, in which the steam pressure in main steam line 38 is plotted against time, and in which the events and conditions of significant elements are overlaid on the same time scale. Those elements, whose operation is unimportant to the present invention, are omitted from FIG. 3.

In a cold start, boiler 12 is cold, steam turbine-generator system 10 is rotating on turning gear to avoid shaft bowing and all valves are either closed or their positions are a matter of indifference at this time. Fuel burners (not shown) in boiler 12, which may burn any combination of hydrogen, carbon, hydrocarbon or other fuel, elevate the temperature of water in boiler 12 until steam generation begins. This may require from about one to about two hours. Main stop valve 62 and main control valve 64 remain closed and high-pressure bypass valve 66 is adjusted to permit a small amount of steam to flow therethrough in order to limit the temperature rise of reheat portion 56.

Low-pressure bypass valve 70 is adjusted to attempt to maintain a pressure in hot reheat line 46 of about 25 percent of the full operational pressure, or about 116 PSIG. The small flow through high-pressure bypass valve 66 which develops as the boiler temperature comes up soon exceeds the pressure setpoint of low-pressure bypass valve 70. Intercept stop valve 58 and intercept control valve 60 remain closed and low-pressure bypass valve 70 then begins to open sufficiently to maintain the setpoint pressure in hot reheat line 46 by releasing steam to condenser inlet line 72 and thence to the condenser 50 (FIG. 1).

As the steam flow ramps upward with additional firing of boiler 12, the pressure setpoint of high-pressure bypass valve 66 is increased at a rate which produces a desired rate of pressure increase on main steam line 38. When the pressure in main steam line 38 reaches between about 400 and 500 PSIG, sufficient vacuum is developed in steam turbine-generator system 10 to permit rolling steam turbine-generator system 10 off turning gear for a period of prewarming.

During the prewarming and initial loading periods, it is desirable that a substantial amount of the energy in the steam fed to high-pressure steam turbine 16 be dissipated without steam turbine-generator system 10 exceeding a desired acceleration profile. This is accomplished by throttling steam flow at this time using main stop valve 62 with main control valve 64 in its fully open, or full-arc, position. Reheater bypass control valve 80 is opened to permit all of the steam exiting high-pressure steam turbine 16 on high-pressure turbine exhaust line 42 to flow therethrough to reheat turbine inlet line 48 and thence to reheat turbine 18. Since high-pressure bypass valve 66 is throttling flow to cold reheat line 44 in order to maintain the increasing setpoint pressure in main steam line 38, the pressure in high-pressure turbine exhaust line 42 remains lower than the pressure in cold reheat line 44. Thus, check valve 54 remains in its sealing condition.

As thus operated, steam turbine-generator system 10 functions as a straight, non-reheat, condensing steam turbine. Precise control is attained because high-pressure bypass valve 66, not requiring a capacity to control the fully loaded steam flow, may be small enough to give the required control precision of pressure in main steam line 38. Main stop valve 62 is relatively inefficient compared to main control valve 64. Thus, a substantial amount of steam energy is dissipated in main stop valve 62 during this period. In addition, the ability to maintain main control valve 64 in its full-arc position aids in evenly warming the rotor of high-pressure steam turbine 16.

The three-to-one pressure drop provided by constriction 82 in reheater bypass control valve 80 maintains a back pressure on high-pressure steam turbine 16 sufficient to permit the turbine stages in high-pressure steam turbine 16 to absorb a substantial amount of steam energy therein without excessive acceleration. The exhaust steam from high-pressure steam turbine 16 passing through reheat turbine 18 warms the rotor of reheat turbine 18 at a controllable rate consistent with the desired limits on thermal gradients in reheat turbine 18.

The above prewarming operation may begin about four hours after boiler start and the speed of steam turbine-generator system 10 may be held at an intermediate value of, for example, about 1000 RPM for a desired period long enough to permit heat soaking the rotor before further acceleration of steam turbine-generator system 10 to synchronous speed.

During prewarming, the setpoint of high-pressure bypass valve 66 is held at a value of, for example, about 40 percent of full operational pressure, or 800 PSIG. This diverts increasing quantities of steam through high-pressure bypass valve 66, reheat portion 56 and low-pressure bypass valve 70 to the condenser 50 (FIG. 1). Low-pressure bypass valve 70 continues to maintain its setpoint pressure of about 116 PSIG in hot reheat line 46. This pressure is high enough to maintain check valve 54 in its closed condition.

While the pressure is held at 800 PSIG, and after a sufficient period of prewarming at the intermediate speed is completed, steam turbine-generator system 10 is further accelerated toward synchronous speed of, for example, 3600 RPM by controlling main stop valve 62. By holding the pressure at 800 PSIG, an increasing amount of steam is made available for acceleration, sychronization, and initial loading.

At or about the time synchronization is accomplished, initial loading can begin. This is performed by opening intercept stop valve 58 and increasing the setpoint of intercept control valve 60 to permit the initiation of steam flow through intercept control valve 60 to reheat turbine 18. The pressure setpoint of low-pressure bypass valve 70 is also raised to about 160 PSIG at this time. When intercept control valve 60 opens, the steam pressure fed therethrough to reheat turbine inlet line 48 is reflected backward through the three-to-one pressure drop in constriction 82 to increase the steam pressure in high-pressure turbine exhaust line 42 to a value exceeding the controlled pressure in cold reheat line 44. Since pressure in high-pressure turbine exhaust line 42 now is higher than the pressure in cold reheat line 44, check valve 54 is forced to open. The opening of check valve 54 is sensed by conventional means to provide a signal on a signal line 90 which triggers control system 32 (FIG. 1) to open intercept control valve 60 and close reheater bypass control valve 80. In this configuration, steam turbine-generator system 10 operates as a reheat steam turbine except for a continuing flow of steam through high-pressure bypass valve 66 and low-pressure bypass valve 70 to maintain their setpoint pressures.

When sufficient additional steam is available to permit it, the setpoint of high-pressure bypass valve 66 is increased in a timed program to maintain the loading of steam turbine-generator system 10 within desired limits until the operational pressure of 2000 PSIG is reached. The firing of boiler 12 is preferably controlled to maintain a steam flow within the ability of high-pressure bypass valve 66 to control the pressure in main steam line 38. At least a portion of the steam flow through cold reheat line 44, now including contributions both from high-pressure bypass valve 66 and high-pressure steam turbine 16, is fed through intercept control valve 60 to reheat turbine 18.

After the steam pressure in main steam line 38 reaches its operational pressure of 2000 PSIG, the steam pressure is maintained at that value by the firing rate of boiler 12 and by the control of main stop valve 62, and later of main control valve 64 aided by the control of high-pressure bypass valve 66.

At an intermediate load point of, for example, between 40 and 60 percent of operational pressure, a coordinated transfer is made to the more efficient control provided by main control valve 64. At the transfer time, main control valve 64 is closed to partial arc while main stop valve 62 is fully opened. This coordinated transfer is made with a negligible change in loading as it is performed.

Following completion of the transfer to partial arc control by main control valve 64, the pressure setpoint of high-pressure bypass valve 66 is increased to a value exceeding the operational pressure and high-pressure bypass valve 66 is thus maintained in the closed position during subsequent operation. Subsequent pressure control is performed by controlling the boiler firing rate along with the position of main control valve 64. The pressure setpoint of low-pressure bypass valve 70 is increased to a value in excess of the operational pressure in hot reheat line 46. Low-pressure bypass valve 70 thus thereafter is maintained in the closed condition.

Further loading and control of steam turbine-generator system 10 is accomplished in a conventional manner.

It will be especially noted that, during rolloff from turning gear, prewarming at 1000 RPM, acceleration to synchronous speed and initial loading from a cold start, the operation of the elements within dashed box 88 is integrated with the operation of high-pressure bypass valve 66, low-pressure bypass valve 70, intercept control valve 60 and main stop valve 62 to tailor the heating rate and acceleration of steam turbine-generator system 10 to values which give steam turbine-generator system 10 an improved cyclic lifetime.

Operation During Hot Start

Prior to a hot start, it is assumed that the rotors of steam turbine-generator system 10 are hot and either may be on turning gear, or may not have slowed to a speed at which turning gear become engaged.

Although the rotors of high-pressure steam turbine 16 and reheat turbine 18 are hot, it is assumed that the rotor of reheat turbine 18, in particular, has cooled to a temperature which is so far below the temperature of the steam which can rapidly be made available from reheat portion 56 that an excessive thermal gradient would be set up in the rotor of reheat turbine 18 if full-temperature steam from reheat portion 56 were admitted through intercept control valve 60 to reheat turbine 18.

In contrast to the cold startup, a warm start does not require several hours of boiler firing and does not usually require an extended period of prewarming. Simply stated, reheater bypass assembly 76 adds a parallel flow of cooler steam from the exhaust of high-pressure steam turbine 16 to the flow of steam admitted to reheat turbine inlet line 48 through intercept control valve 60 so that the combined steam temperature is within an appropriate temperature range for the metal temperature in reheat turbine 18. In order to obtain cooler steam from high-pressure steam turbine 16, the setpoint of low-pressure bypass valve 70 is adjusted to control the pressure in hot reheat line 46 to a value which produces a larger pressure drop in high-pressure steam turbine 16 than would occur if the full operational pressure of about 400 PSIG were available in hot reheat line 46. The larger pressure drop permits high-pressure steam turbine 16 to dissipate more steam energy. The lower high-pressure turbine stage pressure reduces windage losses and potential over temperature of the high pressure stages. A pressure setpoint of about 55 percent of full pressure (216 PSIG) is employed on low-pressure bypass valve 70 in the preferred embodiment.

The pressure setpoint of high-pressure bypass valve 66 is also set to an intermediate value which, in the preferred embodiment, is 55 percent of full pressure (1100 PSIG). A minimum open value of about 10 percent is manually selected to permit at least some steam to flow through reheat portion 56 as boiler firing proceeds and steam pressure becomes available. The boiler firing rate can be high since this is a hot start.

Main stop valve 62, main control valve 64, intercept stop valve 58, intercept control valve 60 reheater bypass stop valve 78 and reheater bypass control valve 80 are closed at this time until sufficient steam pressure is available to permit rolloff or the start of acceleration.

When sufficient steam is available, main stop valve 62, intercept stop valve 58 and reheater bypass stop valve 78 are all fully opened. Steam is admitted through main control valve 64 to high-pressure steam turbine 16. A parallel flow of steam passes through high-pressure bypass valve 66 and reheat portion 56 for throttled flow through intercept control valve 60 to reheat turbine 18. The pressure in hot reheat line 46 remains limited at this time by low-pressure bypass valve 70. The pressure in cold reheat line 44 remains higher than the pressure in high-pressure turbine exhaust line 42 thus maintaining check valve 54 in the closed position. The mixed steam entering reheat turbine 18 is at a temperature within the limits of the desired thermal gradient in reheat turbine 18.

The speed of steam turbine-generator system 10 optionally may be either held at an intermediate speed or accelerated at a controlled rate directly to synchronous speed. At synchronous speed, electric generator 30 is connected to the power system grid. Loading can then proceed.

Loading is performed by fully opening intercept control valve 60, and thereafter by adjusting the pressure setpoint of high-pressure bypass valve 66 as the boiler pressure increases. As intercept control valve 60 is opened, low-pressure bypass valve 70 closes in an attempt to maintain its setpoint pressure in hot reheat line 46. The pressure setpoint of low-pressure bypass valve 70 is raised to a value in excess of the operational pressure in hot reheat line 46 and therefore remains closed. As intercept control valve 60 opens, the increased pressure in reheat turbine inlet line 48 is reflected back through the three-to-one pressure ratio of constriction 82 to increase the pressure in high-pressure turbine exhaust line 42 to a value exceeding the pressure in cold reheat line 44. Check valve 54 is thus opened to admit exhaust steam from high-pressure steam turbine 16 directly to cold reheat line 44, and reheater bypass control valve 80 is closed.

When the pressure threshold of high-pressure bypass valve 66 has increased to provide the operational steam pressure of 2000 PSIG in main steam line 38, high-pressure bypass valve 66 closes in an attempt to maintain this pressure. Thereafter, all of the steam flow passes in the normal fashion of a conventional reheat turbine system through high-pressure steam turbine 16, reheat portion 56 and reheat turbine 18. Additional loading is likewise conventionally performed.

OPERATION FOLLOWING A TRIP OR LOAD REJECTION

The initial conditions for operation following a trip or load rejection is similar to those for a hot start except that full operational steam pressure of 2000 PSIG is maintained in boiler 12 by high-pressure bypass valve 66. The firing rate of boiler 12 may be at, for example, 50 percent of maximum continuous rating. The pressure setpoint of low-pressure bypass valve 70 is set at about 55 percent of operational pressure to maintain steam pressure in hot reheat line 46 at this level, and to control the pressure drop across high-pressure steam turbine 16 and the consequent temperature drop in the steam passing therethrough.

At this time, main stop valve 62, intercept stop valve 58 and reheater bypass stop valve 78 are fully opened. Steam is throttled to high-pressure steam turbine 16 through main control valve 64 and to reheat turbine 18 through intercept control valve 60 to accelerate steam turbine-generator system 10 to an intermediate speed, if desired, at an acceleration which provides a controlled warming rate. A flow of cooler steam through high-pressure steam turbine 16 and reheater bypass assembly 76 mixes with a parallel flow of hotter steam through intercept control valve 60 to apply steam at a desired temperature to reheat turbine 18.

At the end of the optional period of intermediate speed, main stop valve 62 and intercept control valve 60 are controlled to accelerate steam turbine-generator system 10 further to synchronous speed at which electric generator 30 is connected to the power grid.

Main control valve 64 is controlled to increase the loading while intercept control valve 60 is fully opened. Reheater bypass control valve 80 is closed and the pressure setpoints of high-pressure bypass valve 66 and low-pressure bypass valve 70 are raised to values in excess of full operational pressure to ensure that they remain closed. As before, the final operational condition is attained in which all of the steam flows through high-pressure steam turbine 16, check valve 54 (which opened as intercept control valve 60 became fully open) and reheat turbine 18.

Conclusion

One skilled in the art will recognize that the principal difference between a cold start and either of the hot starts is found in the pressure setting of low-pressure bypass valve 70. This difference influences the work done by the steam in passing through high-pressure steam turbine 16. Such a skilled person is also enabled to adapt the disclosure to a different set of operational conditions in which selection of a different pressure setpoint is appropriate for low-pressure bypass valve 70 in order to accommodate a particular operating condition.

The other significant difference between the hot and cold starts is seen in the use of throttling by main stop valve 62 with full-arc operation of main control valve 64 during prewarming until partial load is applied, as compared to the hot-start technique which uses partial arc operation of main control valve 64. In the early stages of a cold start, advantage is taken of the relative inefficiency of main stop valve 62 to decrease the temperature of the steam exiting high-pressure steam turbine 16 as much as possible. Also, full-arc operation of main control valve 64 is desirable in this period to improve the uniformity of heating the buckets and turbine wheels in high-pressure steam turbine 16. When the full-arc-to-partial-arc transfer takes place, heat soaking of high-pressure steam turbine 16 has proceeded sufficiently far to require neither the inefficiency of main stop valve 62 nor the heating uniformity of full-arc operation of main control valve 64.

Control system 32 may employ any convenient technology for producing the control signals applied to steam turbine-generator system 10. For example, control system 32 may consist solely of manual controls responsive to manual input 34. In such a purely mechanical control system, an operator determines suitable control settings on the basis of sensor readings such as, for example, temperatures, pressures, time, speed and power output and produces control outputs in response thereto. Alternatively, control system 32 may consist of a fully automatic startup and loading system which, once enabled, performs all of the startup and loading steps automatically. Such an automatic system may include any suitable conventional computing and control apparatus to produce the control signals. In the preferred embodiment, a manually aided automatic control system is employed in control system 32. That is, each significant step in the startup and loading function is initiated by a manual input. Upon the completion of a significant step, the operator is called on to supervise the manual initiation of the next significant step. Such a manual-aided automatic control system is capable of using less sophisticated control and sensing components, and is further capable of taking advantage of the unique reasoning capability of a human operator.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A steam turbine-generator system comprising:

a high-pressure steam turbine;

a reheat turbine;

a boiler including means for heating steam for delivery to said high-pressure steam turbine and a boiler reheat portion for reheating an exhaust steam from said high-pressure steam turbine for delivery to said reheat turbine;

main valve means for admitting steam from said boiler to said high-pressure steam turbine;

an intercept control valve for admitting steam from said boiler reheat portion to said reheat turbine;

means for maintaining at least a selectable predetermined pressure in said boiler reheat portion;

a reheater bypass assembly connected between a high-pressure turbine exhaust line of said high-pressure steam turbine and a reheat turbine inlet line of said reheat turbine, said reheater bypass assembly bypassing said reheat portion and said intercept control valve;

a check valve in said high-pressure turbine exhaust line downstream of said reheater bypass assembly; and said check valve including means for preventing a flow of steam from said high-pressure turbine exhaust line to said reheat portion while an exhaust pressure of steam from said high-pressure steam turbine is less than said selectable predetermined pressure, whereby exhaust steam from said high-pressure steam turbine passes through said reheater bypass assembly directly to said reheat turbine without passing through said reheat portion during at least a portion of a startup cycle.

2. A steam turbine-generator system according to claim 1 wherein said means for maintaining at least a selectable predetermined pressure includes a high-pressure bypass valve connected from said boiler to said boiler reheat portion bypassing said high-pressure steam turbine, and a low-pressure bypass valve connected to a hot reheat line of said reheat portion bypassing said reheat turbine, said high-pressure bypass valve being adjustable to pass a predetermined minimum steam flow to said reheat portion and said low-pressure bypass valve including means for maintaining said selectable predetermined pressure in said hot reheat line whereby said predetermined selectable pressure is maintained in said reheat portion.

3. A steam turbine-generator system according to claim 2 wherein said high-pressure bypass valve includes means for maintaining a second predetermined selectable pressure in said boiler for feeding steam to said high-pressure steam turbine.

4. A steam turbine-generator system according to claim 2 wherein said low-pressure bypass valve includes means for receiving a pressure setpoint for adjusting said selectable predetermined pressure, said check valve being responsive to a predetermined relationship between a pressure in said high-pressure turbine exhaust line and said selectable predetermined pressure for opening at a predetermined thermodynamic condition of said steam turbine-generator system whereby normal reheat turbine operation is begun.

5. A steam turbine-generator system according to claim 4 wherein said selectable predetermined pressure is selectable according to a type of starting condition.

6. A steam turbine-generator system according to claim 5 wherein said type of starting condition includes at least a cold start and a hot start and said selectable predetermined pressure is selected higher for said hot start than for said cold start.

7. A steam turbine-generator system according to claim 1 wherein said main valve means includes at least a main stop valve and a main control valve, said main control valve being fully opened and said main stop valve performing throttling of steam to said high-pressure steam turbine during at least a portion of a cold start of said steam turbine-generator system.

8. A steam turbine-generator system according to claim 7 wherein said main stop valve is controllable to a fully opened condition and said main control valve is transferable to a throttling condition at a predetermined loading condition of said steam turbine-generator system.

9. A steam turbine-generator system according to claim 1 wherein said reheater bypass assembly includes means for producing a predetermined pressure ratio thereacross, said predetermined pressure ratio being effective for at least partly determining a condition for opening said check valve.

10. A method for startup of a steam turbine-generator system of a type including a high-pressure steam turbine, a reheat turbine, a boiler including means for heating steam for delivery to said high-pressure steam turbine and a reheat portion for reheating an exhaust steam from said high-pressure steam turbine for delivery to said reheat turbine, main valve means for admitting steam from said boiler to said high-pressure steam turbine, and an intercept control valve for admitting steam from said reheat portion to said reheat turbine, comprising:

maintaining at least a selectable predetermined pressure in said reheat portion;

bypassing said exhaust steam from said high-pressure steam turbine to an inlet of said reheat turbine without passing said exhaust steam through said reheat portion and said intercept control valve; and preventing a flow of steam from said high-pressure steam turbine to said reheat portion while an exhaust pressure of said exhaust steam from said high-pressure steam turbine is lower than said selectable predetermined pressure, whereby said exhaust steam from said high-pressure steam turbine passes directly to said reheat turbine without passing through said reheat portion during at least a portion of a startup cycle.

11. A method according to claim 10 wherein said main valve means includes at least a main stop valve and a main control valve, the method further comprising:

fully opening said main control valve; and throttling said steam to said high-pressure steam turbine with said main stop valve during at least a portion of a cold start of said steam turbine-generator system.

12. A method according to claim 11, further comprising controlling said main stop valve to a fully opened condition and said main control valve to a throttling condition at a predetermined loading condition of said steam turbine-generator system.

13. A method according to claim 10 further comprising producing a predetermined pressure ratio between an exhaust of said high-pressure steam turbine and an inlet of said reheat turbine, said predetermined pressure ratio being effective in at least partly determining a condition for passing said exhaust steam from said exhaust of said high-pressure steam turbine to said reheat portion.

* * * * *